US005567890A

United States Patent [19]

Lindberg et al.

[11] Patent Number: 5,567,890

[45] Date of Patent: Oct. 22, 1996

[54] IRON-BASED POWDER COMPOSITION HAVING GOOD DIMENSIONAL STABILITY AFTER SINTERING

[75] Inventors: Caroline Lindberg; Bjorn Johansson, both of Höganäs, Sweden

[73] Assignee: Hoganas AB, Hoganas, Sweden

[21] Appl. No.: 162,101

[22] PCT Filed: Jun. 12, 1992

[86] PCT No.: PCT/SE92/00399

§ 371 Date: Dec. 10, 1993

§ 102(e) Date: Dec. 10, 1993

[87] PCT Pub. No.: WO92/22395

PCT Pub. Date: Dec. 23, 1992

[30] Foreign Application Priority Data

Jun. 12, 1991 [SE] Sweden ..... 9101819

[51] Int. Cl.[6] ..... C22C 33/00

[52] U.S. Cl. ..... 75/243; 75/246; 75/355; 419/11; 419/38

[58] Field of Search ..... 75/252, 243, 246, 75/355; 419/11, 38

[56] References Cited

U.S. PATENT DOCUMENTS

| | | | |
|---|---|---|---|
| 4,128,420 | 12/1978 | Esper et al. | 75/230 |
| 4,561,893 | 12/1985 | Takajo | 75/251 |
| 4,702,772 | 10/1987 | Engstrom et al. | 75/243 |
| 4,954,171 | 9/1990 | Takajo et al. | 75/246 |

FOREIGN PATENT DOCUMENTS

| | | |
|---|---|---|
| 024217 | 2/1981 | European Pat. Off. . |
| 200691 | 12/1986 | European Pat. Off. . |
| 274542 | 4/1988 | European Pat. Off. . |
| 334968 | 10/1989 | European Pat. Off. . |
| 2112944 | 10/1971 | Germany . |
| 2613255 | 7/1982 | Germany . |
| 1305608 | 2/1973 | United Kingdom . |

OTHER PUBLICATIONS

Second International Search Report for the present application (PCT/SE92/00399) (Dated Sep. 22, 1992).

International Preliminary Examination Report for the present application (PCT/SE 92/–0399).

First Search Report for the present application ("International–type Search Report" dated Jan. 21, 1992.

*Primary Examiner*—Ngoclan Mai

*Attorney, Agent, or Firm*—Kane, Dalsimer, Sullivan, Kurucz, Levy, Eisele and Richard

[57] ABSTRACT

An iron-based powder for producing highly resistant components with a small local variation in dimensional change, by powder compacting and sintering. The powder contains, in addition to Fe, 0.5–4.5% by weight Ni, 0.65–2.25% by weight Mo and 0.35–0.65% by weight C, and optionally a lubricant and impurities. The maximum variation in dimensional change is 0.07% for a minimum density of 6.7 g/cm$^3$.

12 Claims, 6 Drawing Sheets

FIG. Ia
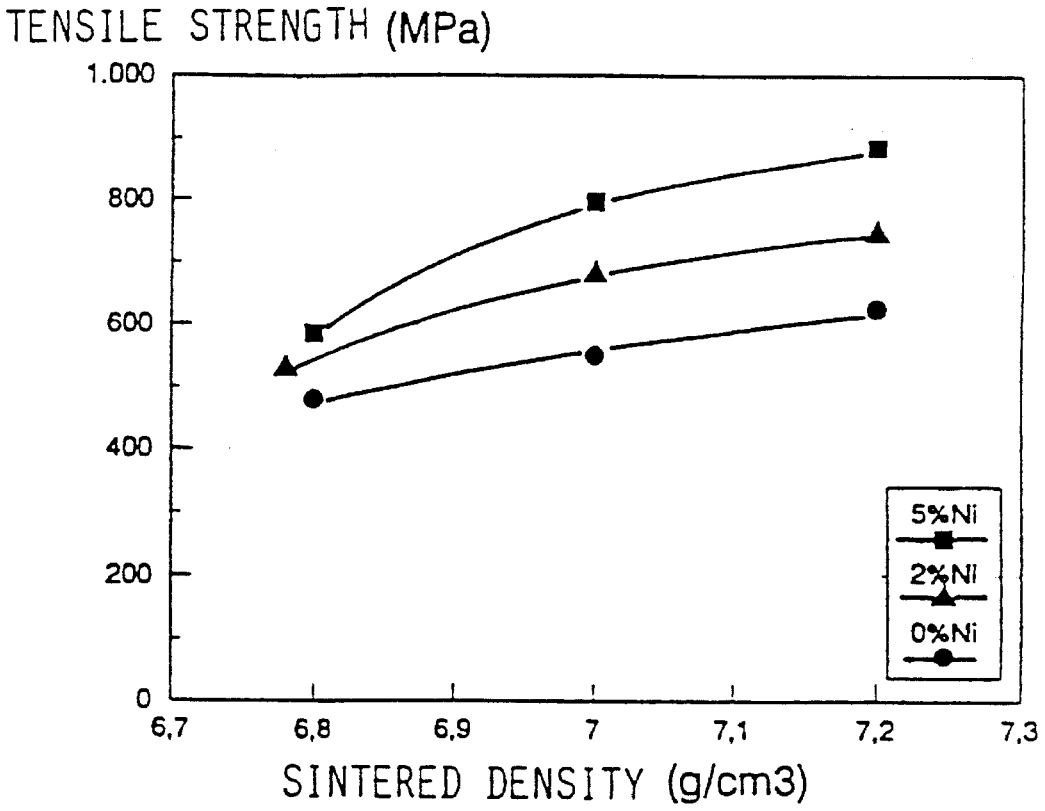

IRON-BASED POWDER COMPOSITION HAVING GOOD DIMENSIONAL STABILITY AFTER SINTERING

The present invention relates to an iron-based powder which after powder compacting and sintering gives dimensionally stable products, i.e. products inherently exhibiting similar dimensional changes, also in the event of local density variations.

A major advantage of powder-metallurgical processes over conventional techniques is that components of varying complexity can be sintered into final shape immediately after powder compacting, and they therefore require but a relatively limited aftertreatment as compared with e.g. a conventional steel blank. Also in the development of new powder-metallurgical materials, it is an aim to ensure that the dimensional change is small during sintering, since it has been found difficult in practice to maintain the dimensional stability if the dimensional change is considerable. This is especially important in the case of high-strength materials which are difficult to adjust to correct measurement after sintering. Therefore, it is vital that the dimensional change is minimal and as independent as possible of variations in the process parameters sintering time, sintering temperature, carbon content and distribution of alloying substances. In the development of high-strength diffusion-alloyed materials during the 1970s, the primary objective precisely was to make the dimensional change as independent as possible of these process variables.

By the diffusion-alloying technique, the alloying substances Ni, Cu and Mo have become uniformly distributed in the material and the contents of these substances can be so selected that variations in the other process parameters time, temperature and C-content have but a small effect on the dimensional change. On the other hand, it has been found that the dimensional change is not constant for different density levels in these materials. In the compaction of powder mixtures, the density may in fact vary considerably within the compacted component and in particular if the geometrical shape is complex. For example, density differences about 0.4 g/cm$^3$ are not at all unusual in practice. This, in turn, may give rise to different dimensional changes locally during sintering, thus making the material "warp", which may mean that it will have to be rejected.

One object of the present invention is to provide a dimensionally stable sintered product. The expression "dimensionally stable" as used in this context means that the product undergoes a similar dimensional change despite inherent density differences. Thus, it is possible according to the invention to produce a product which, although exhibiting inherent density differences, has a variation in the dimensional change of at most about 0.07%, preferably at most about 0.05% at a minimum density of about 6.7 g/cm$^3$, especially in the density range of 6.8–7.2 g/cm$^3$. The dimensional change during the sintering process need however not be zero, since the pressing tools can be adjusted in size already at the design stage so as to obtain the correct shape after sintering.

Another object of the invention is to produce an iron-powder-based material which after compacting and sintering yields a dimensionally stable product having high strength. For instance, it is possible with the iron-powder-based material according to the invention to produce sintered products having a tensile strength above about 450 MPa, especially between 500 and 1000 MPa, and preferably between 550 and 950 MPa, without the sintered product being subjected to subsequent heat treatment.

Yet another object of the invention is to produce a powder which by a simple and inexpensive low-temperature sintering process yields a product having the properties specified above.

The invention embraces also such powders as after compacting and sintering exhibit not only good dimensional stability and high strength but also high fatigue strength. In these powders, the nickel content is comparatively high and preferably is in the range of 2–4.5% by weight.

According to the invention, these objects can be achieved by a powder composition which, in addition to iron, includes 0.5–4.5% by weight of nickel, 0.65–2.25% by weight of molybdenum, and 0.35–0.65% by weight of carbon. The invention is also directed to products produced from the stated compositions, and to a method for producing the products on the basis of the compositions. Moreover, the invention relates to the use of the powder compositions for producing sintered products. The other features of the invention are recited in the accompanying claims.

Compositions containing the components Fe, Ni and Mo in approximately the same contents as in the present invention are previously known from EP 0,334,968. These known compositions are intended for use in the making of products which after sintering and heat treatment (quenching and tempering) are distinguished by a very high strength and high hardness. However, the EP publication does not contain any information or indication whatever of any particular advantages of these powder compositions when it comes to producing dimensionally stable and high-strength products obtained by simple sintering without any subsequent heat treatment. Since it is well-known that the dimensional accuracy is impaired in heat treatment, it is not possible by using the method disclosed in EP 0,334,968 to achieve the object of the present invention.

DOS 2,112,944 also discloses powder compositions including Ni and Mo in such amounts as to place the present powder compositions within the ranges here suggested. However, the compositions of DOS 2,112,944 also include Mn as a compulsory component, whereas any Mn present in the powder composition according to the invention is an undesirable impurity. Consequently, it is preferred according to the present invention that the content of Mn is at a minimum and less than 0.3% by weight, preferably less than 0.1% by weight. The DOS publication further mentions Ni, Mn, Mo and Fe as completely prealloyed powders. Reference is also made to DE 1,207,634, in which Ni and/or Mo and/or Mn is/are added to an iron base powder, either as pure substances, or as master alloys (which means that at least two of the included alloying substances form a chemically homogeneous powder) or as ferro-alloy powder (chemically homogeneous material in which iron is included, but with essentially higher alloying contents as compared with the material of the invention). These variants of powder mixtures are not comprised by the present invention. Nor do these publications teach or suggest anything whatever about the advantages that can be gained with the invention.

The powder compositions according to the invention have proved well suited for use in so-called low-temperature sintering, which means sintering at temperatures below about150° C. Such sintering may advantageously be performed in belt furnaces. Sintering in such furnaces usually takes place at temperatures of about 1120° C.–1140° C. for at most 1 hour, generally between 20 and 40 min. Before the powder compositions are passed into the sintering furnace, they are first admixed with a lubricant and thereafter moulded in a pressing tool under high pressure. For highly resistant products, the compacting pressure is in practice about 600 MPa.

For the powder compositions according to the invention, preference is given to such powders in which the nickel content varies between 1.0 and 3.0% by weight and the molybdenum content varies between 0.8 and 2.0% by weight. The best results have hitherto been achieved with compositions in which the content of Ni>the content of Mo, and particularly preferred are compositions containing 1.5% by weight of molybdenum and about 2% by weight of nickel. For products requiring higher fatigue strength, the amount of nickel should be higher, preferably between 2 and 4% by weight.

In addition to the indicated substances, the powder compositions may contain impurities, the content of which should be as low as possible. Examples of impurities in the compositions according to the invention are copper, tungsten and phosphorous, which interfere with the dimensional stability. Other impurities that may also have an adverse effect on the sintered product because of oxidation are chromium, manganese, silicon and aluminium. The total content of impurities should be maintained below 2% by weight, preferably below 1% by weight. In addition, the powder composition of the invention may optionally contain a lubricant of the type which is known to those skilled in the art. In a particularly preferred embodiment, Mo is present in solid solution in a water-atomised iron-based powder. This embodiment provides a powder which imparts to the sintered components a more homogeneous structure on micro level as compared with powders in which Mo is not prealloyed to the iron. At the same time, the sintered density is affected only insignificantly when Mo is prealloyed to the iron. If, on the other hand, Ni is present in solid solution in the iron-based powder, the compressibility of the material is impaired, as is also the sintered density (the Example below shows, for instance, how material B in Table 2 will have a very low density after sintering at the compacting pressures used as compared with the other materials. This material includes about 2% Ni and 0.5% Mo as prealloyed elements in the iron-based powder while material A, which also is completely prealloyed but with about 1.5% Mo, will have a much higher density after sintering under the same process conditions as for material B). Therefore, Ni preferably is in metallic form, it being diffusion-alloyed with the iron-based powder prealloyed by means of Mo. Ni may also in this case be mixed with the prealloyed powder.

The alloying content ranges are selected under the consideration that the material of the invention should satisfy at least three of the conditions stated above, viz., within the limits specified, provide a dimensionally stable sintered product despite varying density levels within the product, provide an iron-powder-based material which after compacting and sintering yields a dimensionally stable product having high strength, and provide a powder which by simple and inexpensive low-temperature sintering without subsequent heat treatment can yield a product having the properties specified above.

BRIEF DESCRIPTION OF THE DRAWINGS

The accompanying FIGS. 1–3 show how the dimensional change varies at different density levels during sintering, and how the tensile strength is affected by the sintered density at different contents of alloying substances Ni, Mo and C. These Figures show compacted and sintered powder mixtures where Mo (if present) has been prealloyed in an atomised iron-based powder having a particle size substantially below 200 μm, while Ni (if present) having a particle size substantially below 15 μm has thereafter been diffusion-alloyed to the iron-based powder. C in the form of graphite having a particle size substantially below 15 μm has thereafter been added to the powder. The powder mixtures have then sintered in a belt furnace at 1120° C. for 30 min in endothermic atmosphere at a carbon potential corresponding to the carbon content of the material.

FIG. 1*a* shows how the tensile strength is improved at increasing density and Ni-content, while FIG. 2*a* illustrates how an increased carbon content improves the tensile strength, while

Figure 1B:
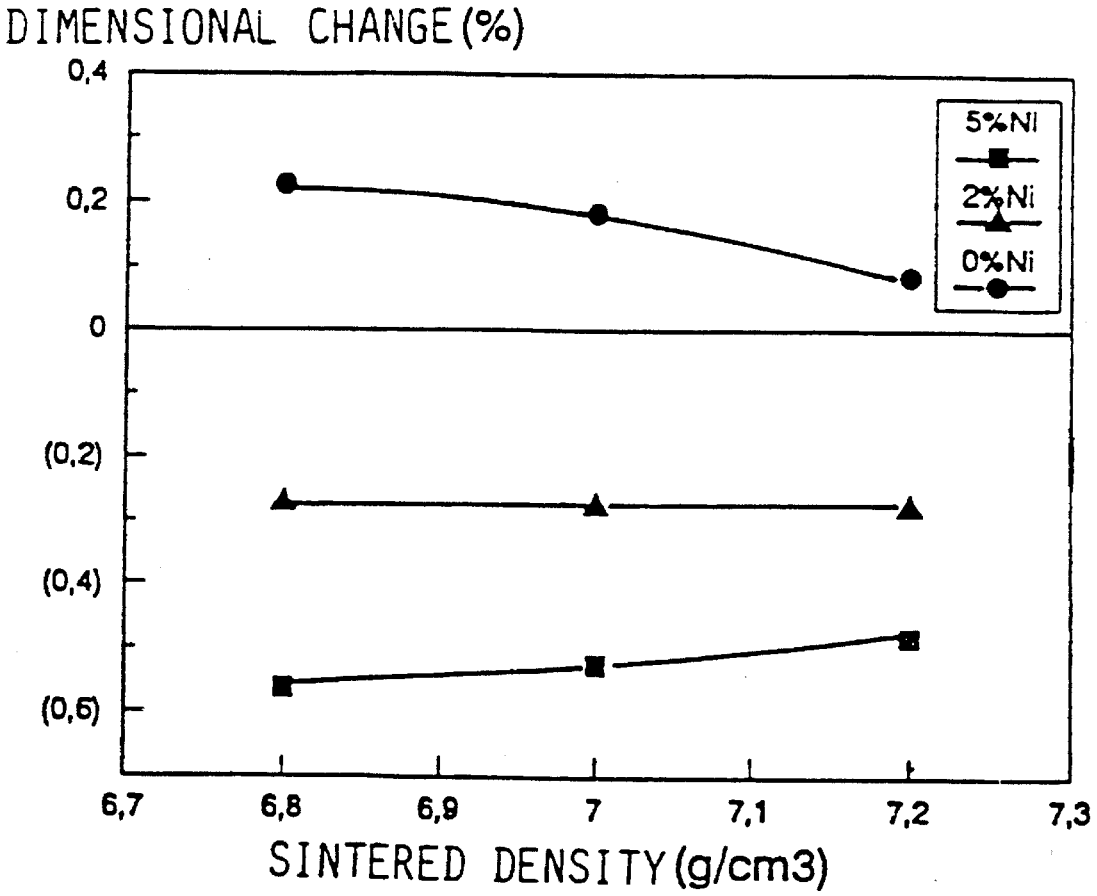
FIG. 1*b* shows how the dimensional change is similar at different density levels for the material of the invention. A too high or a too low Ni-content, i.e., falling outside the stated limits of the inventive material, results in too large variations in dimensional change at different density levels.
Figure 2A:
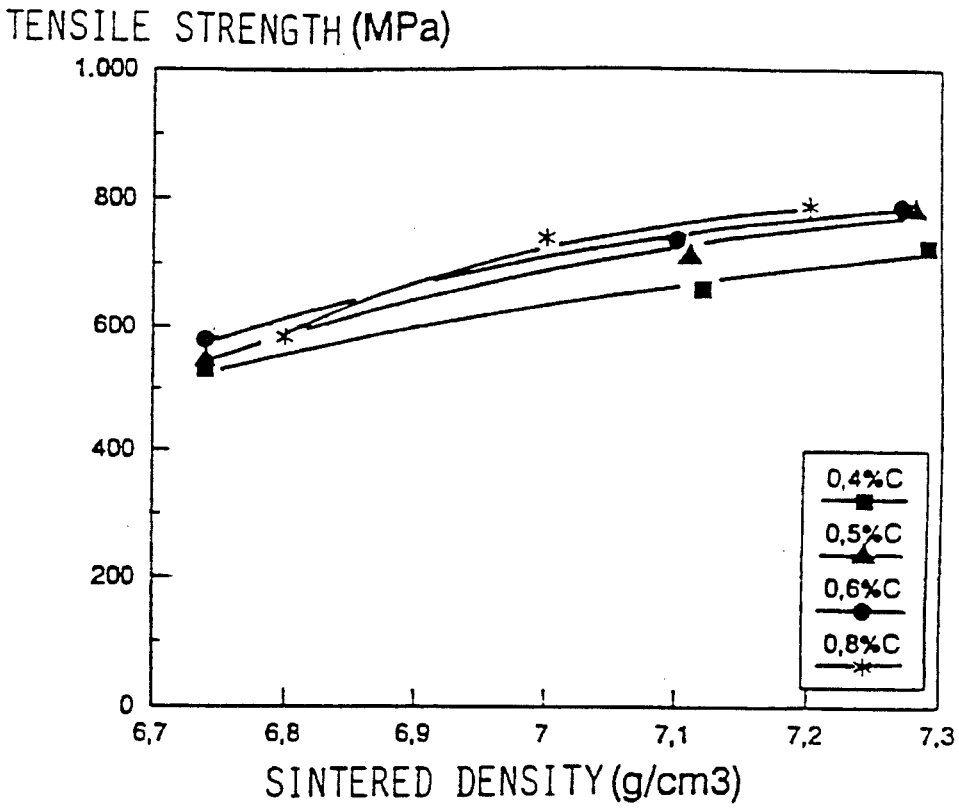
Figure 2B:
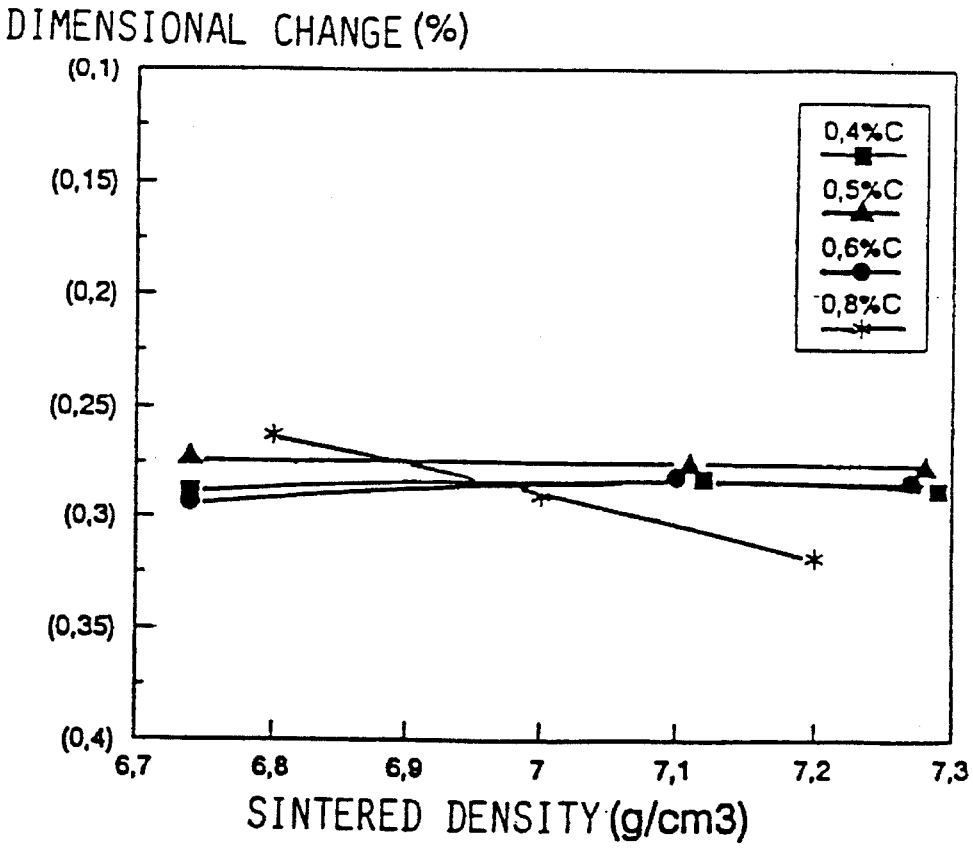
FIG. 2*b* shows that too high a carbon content results in too large a variation in dimensional change at different density levels.
Figure 3A:
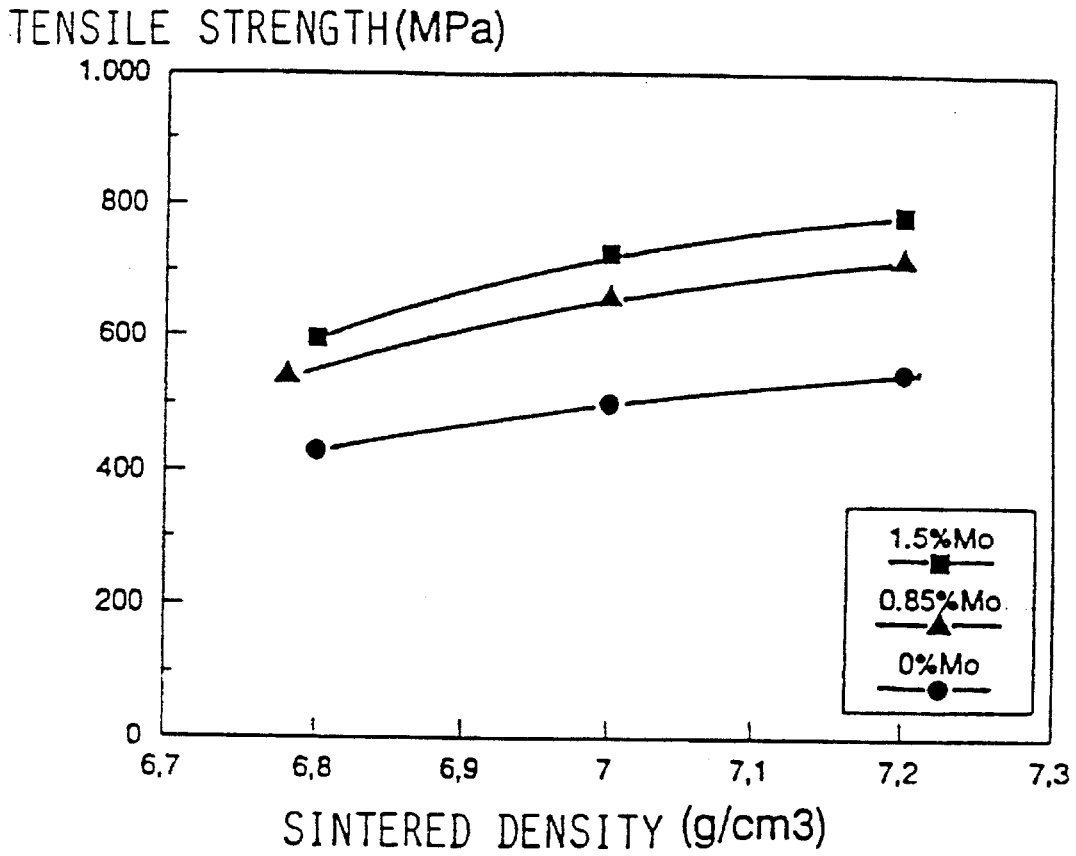
FIGS. 3*a* and *b* show that a certain Mo-content is required to meet the requirements as to strength and similar dimensional change at densities above 6.7 g/cm$^3$.
Figure 3B:
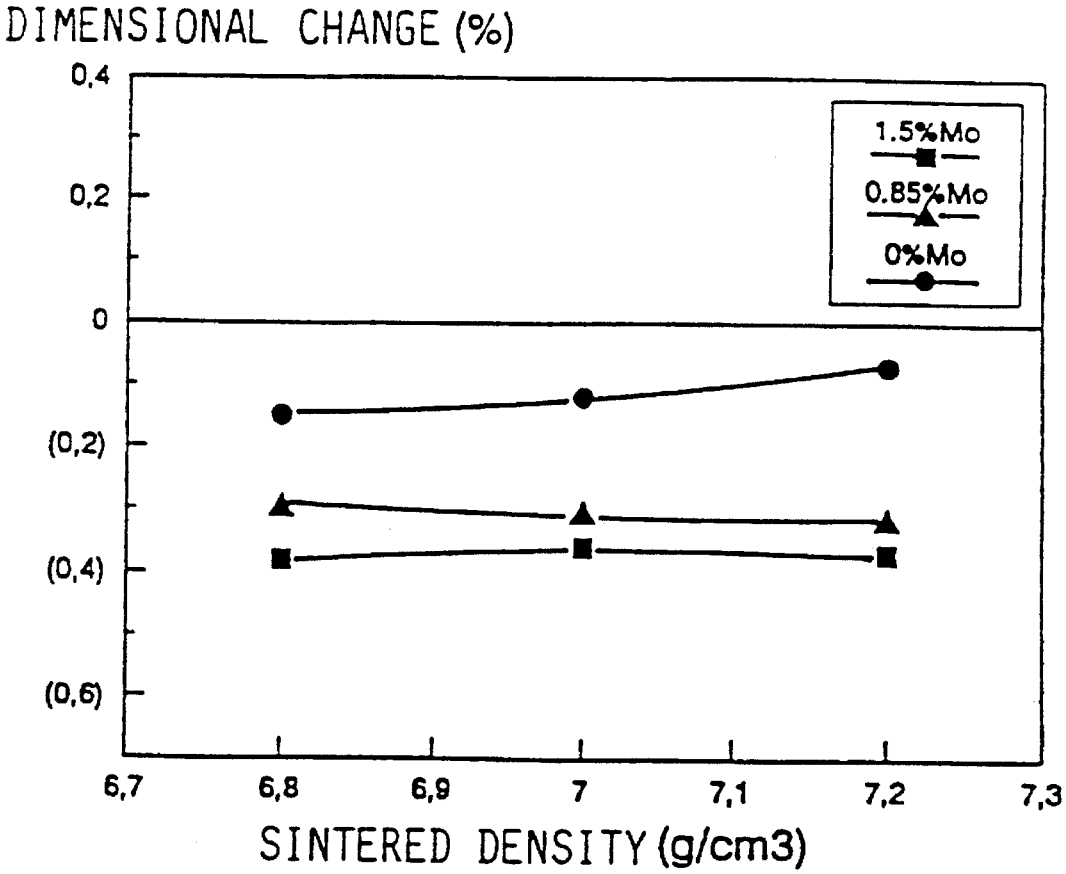

The invention will be illustrated by the Example below. This Example is intended merely to illustrate an embodiment of the invention in a non-restrictive manner.

EXAMPLE

Two different powders (A, B) were prepared by water-atomising an iron melt alloyed both with Mo and with Mo and Ni. The oxygen content was reduced by annealing the atomised powders in reducing atmosphere. In addition, Ni was diffusion-annealed in reducing atmosphere in two contents to the iron-based powder which was prealloyed with Mo (C, D). A non-alloyed iron powder was also prepared by water-atomisation and annealed to reduce the oxygen content. The resulting powder was thereafter diffusion-annealed with different amounts of Mo, Ni and Cu (E, F, G, H). The chemical composition of the different powders appears from Table 1 below.

TABLE 1

Chemical composition of the powder materials tested.

| Powder | Chemical composition (%) | | | |
|---|---|---|---|---|
| | Ni | Mo | Cu | Fe |
| A | — | 1.51 | — | balance |
| B | 1.92 | 0.48 | — | balance |
| C* | 1.98 | 1.52 | — | balance |
| D* | 2.97 | 1.50 | — | balance |
| E* | 2.01 | 1.48 | — | balance |
| F | 3.92 | 0.54 | 1.47 | balance |
| G | 3.99 | 0.53 | — | balance |
| H | 1.72 | 0.53 | 1.47 | balance |

*powder according to the present invention.

The different powders having a particle size substantially below 200 μm were admixed with 0.5% graphite having a particle size substantially below 15 μm and 0.6% Kenolube as lubricant. After mixing, tensile testpieces were compacted at 400, 600 and 800 MPa. Sintering was performed at 1120° C. for 30 min in reducing atmosphere (endogas) at a carbon potential of 0.5%. Methane was added to control the carbon content. After sintering, the tensile strength and the dimensional change were measured for the different materials at varying densities. The result appears from Table 2 below.

TABLE 2

Tensile strength and dimensional change at varying densities

| Material | Tensile strength (MPa) | Sintered density (g/cm$^3$) | Dimensional change (%) |
|---|---|---|---|
| A | 400 | 6.67 | −0.03 |
| | 540 | 7.05 | −0.01 |
| | 602 | 7.22 | −0.01 |
| B | 346 | 6.55 | −0.37 |
| | 458 | 6.98 | −0.33 |
| | 528 | 7.19 | −0.32 |
| C* | 597 | 6.75 | −0.38 |
| | 727 | 7.10 | −0.36 |
| | 785 | 7.27 | −0.37 |
| D* | 640 | 6.79 | −0.53 |
| | 796 | 7.13 | −0.50 |
| | 877 | 7.30 | −0.49 |
| E* | 591 | 6.75 | −0.21 |
| | 696 | 7.08 | −0.19 |
| | 774 | 7.24 | −0.18 |
| F | 699 | 6.80 | −0.37 |
| | 855 | 7.11 | −0.26 |
| | 895 | 7.25 | −0.24 |
| G | 578 | 6.84 | −0.27 |
| | 694 | 7.14 | −0.22 |
| | 757 | 7.32 | −0.18 |
| H | 519 | 6.81 | −0.18 |
| | 620 | 7.11 | −0.12 |
| | 655 | 7.30 | −0.09 |

*Material according to the present invention.

Materials A, B, F and H are previously known, and as appears from the Table, material F gives high strength, but a relatively low variation in dimensional change at different densities. Material G has been produced in the same way, but without addition of Cu. The strength value has therefore dropped, but still is quite acceptable. On the other hand, the variation in dimensional change still is too high in the density range exceeding 6.7 g/cm$^3$. By lowering the Ni-content in material F from about 4% by weight to about 1.75% by weight (=material H), the variation in dimensional change at different densities decreases, but still is too high. The prealloyed materials A and B exhibit a small variation in dimensional change at different densities, but the strength values are too low.

However, it has been found that the combination of a higher Mo-content than in material B, with an Ni-addition gives a material having high strength and a small variation in dimensional change at different densities. As appears from Table 2, the properties become similar in materials C and E, whether Mo is prealloyed (i.e. is added before atomisation) or it is diffusion-alloyed. The only difference is the level of dimensional change, which does not conflict with the invention. Adding more Ni (material D) gives improved strength, but a slightly higher variation in dimensional change than for materials C and E. The variation in dimensional change at different densities however is in compliance with the requirements of the invention.

We claim:

1. A compacted and sintered iron-based powder composition which in addition to iron consists essentially of 0.5–4.5% by weight Ni 0.65–2.25% by weight Mo 0.35–0.65% by weight C, less than about 2% by weight of impurities and optionally lubricant, wherein the powder is sintered at a temperature not greater than 1140° C. and a variation of dimensional change no greater than 0.07%, irrespective of density variations within the range of 6.8–7.2 g/cm$^3$ in the green body, is obtained during sintering.

2. A compacted and low-temperature sintered iron-based powder composition which in addition to iron essentially consists of 0.5–4.5% by weight Ni 0.65–2.25% by weight Mo 0.35–0.65% by weight C, with the balance being Fe, less than about 2% by weight of impurities and optionally lubricant, provided that the powder composition does not consist of by weight 4% Ni, 1% Mo, 0.5% C, wherein the product is sintered at a temperature below about 1150° C. and has a tensile strength of about 500 to 1000 MPa.

3. A composition according to claim 1 wherein Mo is present in solid solution in an atomized iron powder.

4. A composition according to claim 3, wherein Ni is present in metallic form.

5. A composition according to claim 1 wherein the composition essentially consists of 0.5–3.5% by weight Ni 0.65–2.25% by weight Mo 0.35–0.65% by weight C.

6. A composition according to claim 1 wherein the composition essentially consists of 1.0–3.0% by weight Ni 0.8–2.0% by weight Mo.

7. A composition according to claim 1, wherein the composition essentially consists of about 2–4.5% by weight Ni.

8. A method of producing a high-strength compacted and low-temperature sintered body comprising the steps of:

a1) preparing an iron powder and diffusion-alloying Ni and/or Mo to the iron powder or mixing metal particles of Ni and/or Mo to the iron powder, or a2) preparing a melt or iron and molybdenum, water-atomizing the melt to a powder and diffusion-alloying Ni to the resulting powder or mixing metal particles of Ni with the powder, b) adding carbon to the powder obtained, the amount of the included components being so selected that the resulting powder composition in addition to iron essentially consists of about 0.5–4.5% by weight Ni 0.65–2.25% by weight Mo 0.35–0.65% by weight C, less than 2% by weight, preferably less than about 1% by weight, of impurities and optionally lubricant, c) compacting the powder composition for obtaining a green body, and d) sintering the green body at a temperature below 1150° C.

9. A method of producing a high-strength compacted and sintered body comprising the steps of a1) preparing an iron powder provided that the powder composition does not consist of, by weight 4% Ni, 1% Mo, 0.5% C, with the balance being Fe, and diffusion-alloying Ni and/or Mo to the iron powder or mixing metal particles of Ni and/or Mo to the iron powder, or a2) preparing a melt of iron and molybdenum, water-atomizing the melt to a powder and diffusion-alloying Ni to the resulting powder or mixing metal particles of Ni with the powder, b) adding carbon to the powder obtained, the amount of the included components being so selected that the resulting powder composition in addition to iron essentially consists of about 0.5–4.5% by weight Ni 0.65–2.25% by weight Mo 0.35–0.65% by weight C, less than 2% by weight of impurities and optionally lubricant, c) compacting the powder composition for obtaining a green body, and d) sintering the green body whereby the sintering gives a variation in dimensional change no greater than 0.07%, irrespective of density variations within the range of 6.8–7.2 g/cm$^3$ in the green body.

10. A method of producing a high-strength sintered body without subsequently heat treating the sintered body according to U.S. Pat. No. 4,954,171 or EP 334,968 comprising the steps of a1) preparing an iron powder, provided that the powder composition does not consist of by weight, 4% Ni, 1% Mo, 0.5% C, with the balance being Fe and diffusion-alloying alloying Ni and/or Mo to the iron powder or mixing powder, or a2) preparing a melt of iron and molybdenum, water-atomizing the melt to a powder and diffusion-alloying Ni to the resulting powder or mixing metal particles of Ni with the powder, b) adding carbon to the powder obtained, the amount of the included components being so selected that the resulting powder composition in addition to iron essentially consists of about 0.5–4.5% by weight Ni 0.65–2.25% by weight Mo 0.35–0.65% by weight C, less than 2% by weight of impurities and optionally lubricant, c) compacting the powder composition for obtaining a green body, and d) sintering the green body at a temperature below 1150° C. whereby the sintering gives a variation in the dimensional change no greater than 0.07%, irrespective of density variations within the range of 6.8–7.2 g/cm$^3$ in the green body.

11. A method according to claim 8, wherein the sintering is carried out for less than an hour.

12. A method according to claim 8, wherein the compacted powder composition is subjected to a final sintering at a temperature between about 1070° C. and about 1150° C.

* * * * *